US007223108B2

(12) United States Patent
Chiang et al.

(10) Patent No.: US 7,223,108 B2
(45) Date of Patent: May 29, 2007

(54) DUSTPROOF RECEPTACLE CONNECTOR

(75) Inventors: Shu Man Chiang, Tucheng (TW); Chung Hsin Huang, Tucheng (TW); Yi Chiu Kao, Tucheng (TW); Yu-Hung Su, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 103 days.

(21) Appl. No.: 11/305,098

(22) Filed: Dec. 19, 2005

(65) Prior Publication Data

US 2006/0270254 A1 Nov. 30, 2006

(30) Foreign Application Priority Data

Dec. 23, 2004 (TW) ..... 93220762 U

(51) Int. Cl.
*H01R 13/44* (2006.01)

(52) U.S. Cl. ..... 439/137

(58) Field of Classification Search ..... 439/135–137, 439/139, 145

See application file for complete search history.

(56) References Cited

U.S. PATENT DOCUMENTS 3,839,697 A * 10/1974 Obert ..... 439/141
5,167,516 A * 12/1992 Tan et al. ..... 439/141
5,897,387 A * 4/1999 Vallet et al. ..... 439/145
6,767,227 B2 * 7/2004 Yamaguchi et al. ..... 439/137
6,814,594 B1 * 11/2004 Huang ..... 439/137

* cited by examiner

*Primary Examiner*—James R. Harvey
(74) *Attorney, Agent, or Firm*—Rosenberg, Klein & Lee

(57) ABSTRACT

A dustproof receptacle connector includes a dielectric housing, a plurality of female contacts disposed in the housing, and a slider unit installed in the housing. The housing has a receiving cavity with a front opening defined in a front surface thereof, and a pair of mounting holes defined in a rear wall of the housing communicating with the receiving cavity. The slider unit includes a dustproof cover slidably received in the receiving cavity for sealing the front opening and a pair of springs disposed on the dustproof cover. A pair of longitudinal pillars extending backwards from the dustproof cover, with the free end of each pillar slidably disposed in the corresponding mounting hole of the housing. Each spring is retained on the corresponding longitudinal pillar, with one end thereof abutting against the dustproof cover and the other end thereof abutting against the rear wall of the housing.

6 Claims, 5 Drawing Sheets

DUSTPROOF RECEPTACLE CONNECTOR

BACKGROUND OF THE INVENTION

1. Field of the Invention

This invention generally relates to a receptacle connector and, particularly, to a dustproof receptacle connector.

2. The Related Art

In the field of electronic connectors, a type of connector is designed with dustproof function in order to avoid the deterioration of electrical connection even short circuit, which are caused by contamination.

Japan patent NO. 2004-31186 issued on Jan. 29, 2004, disclosed a dustproof receptacle connector, which includes a female shield, a housing enclosed by the female shield, and a plurality of female contacts disposed in the housing. The housing has a receiving cavity with a front opening defined in a front surface thereof. A dustproof cover is slidably received in the receiving cavity for sealing the front opening, with two projecting pillars extending rearwards from the rear surface thereof. Correspondingly, two mounting holes are defined in a rear wall of the housing, and two springs are respectively positioned by one end of each spring retained on the corresponding projecting pillar of the dustproof cover and the other end of each spring infixed in the corresponding mounting hole of the housing. Each female contact has a conductive portion received in the receiving cavity for making electrical connection with a mating plug connector. Thus, when in use, the mating plug connector is inserted into the receptacle connector to push the dustproof cover sliding towards the rear wall of the housing with the springs against the dustproof cover being gradually compressed, so that the conductive portions of the receptacle connector are exposed out entirely of the dustproof cover for making electrical connection with the mating plug connector. When the mating plug connector is pulled out, the elasticity of the compressed springs pushes the dustproof cover to slide outwards to seal the front opening of the receptacle connector for protecting the conductive portions of the female contacts from contaminants such as dust, dirt or moisture.

However, in these prior connectors, each spring is positioned between the projecting pillar of the dustproof cover and the mounting hole of the housing only by two ends of the spring, so the main body of the spring easily oscillates laterally and cause the unsteady sliding of the dustproof cover as the mating plug connector being inserted into the receptacle connector, and furthermore the unsteady sliding of the dustproof cover results in bad dustproof function during the dustproof cover sliding back by the resilience of the springs to seal the front opening of the receptacle connector again. In addition, the springs will depart from the projecting pillars or the mounting holes in a condition of greater lateral deformation of the compressed springs. Therefore, the prior dustproof receptacle connector cannot provide a reliable dustproof function.

SUMMARY OF THE INVENTION

This invention is directed to solving the above problems and provides a dustproof receptacle connector, which includes a dielectric housing, a plurality of female contacts disposed in the housing, and a slider unit installed in the housing. The dielectric housing has a receiving cavity with a front opening defined in a front surface of the housing, and at least one mounting hole defined in a rear wall of the housing communicating with the receiving cavity. Each female contact is disposed in the housing. The slider unit slidably received in the receiving cavity comprises a dustproof cover for sealing the front opening of the receiving cavity and at least one spring. At least one longitudinal pillar extending backwards from the dustproof cover, with the free end of the pillar slidably disposed in the mounting hole of the housing. Each spring is retained on the longitudinal pillar, with one end thereof abutting against the dustproof cover and the other end thereof abutting against the rear wall of the dielectric housing.

In the dustproof receptacle connector of the present invention, with the design of the longitudinal pillar extending into the corresponding mounting hole and the spring retained entirely on the pillar, the lateral deformation of the spring can be avoided. In addition, the mounting hole ensures that the longitudinal pillar only slide in the longitudinal direction, thereby the dustproof cover can steadily and appropriately slide in the receiving cavity. Consequently, the dustproof receptacle connector of the present invention is qualified to keep from the contamination.

BRIEF DESCRIPTION OF THE DRAWINGS

A detailed explanation of a preferred embodiment of the present invention will be given, with reference to the attached drawings, for better understanding thereof to those skilled in the art:

FIG. 7 is a cross-sectional view of the dustproof receptacle connector with the mating plug connector installed in.

DETAILED DESCRIPTION OF THE PREFERRED EMBODIMENT

Figure 1:
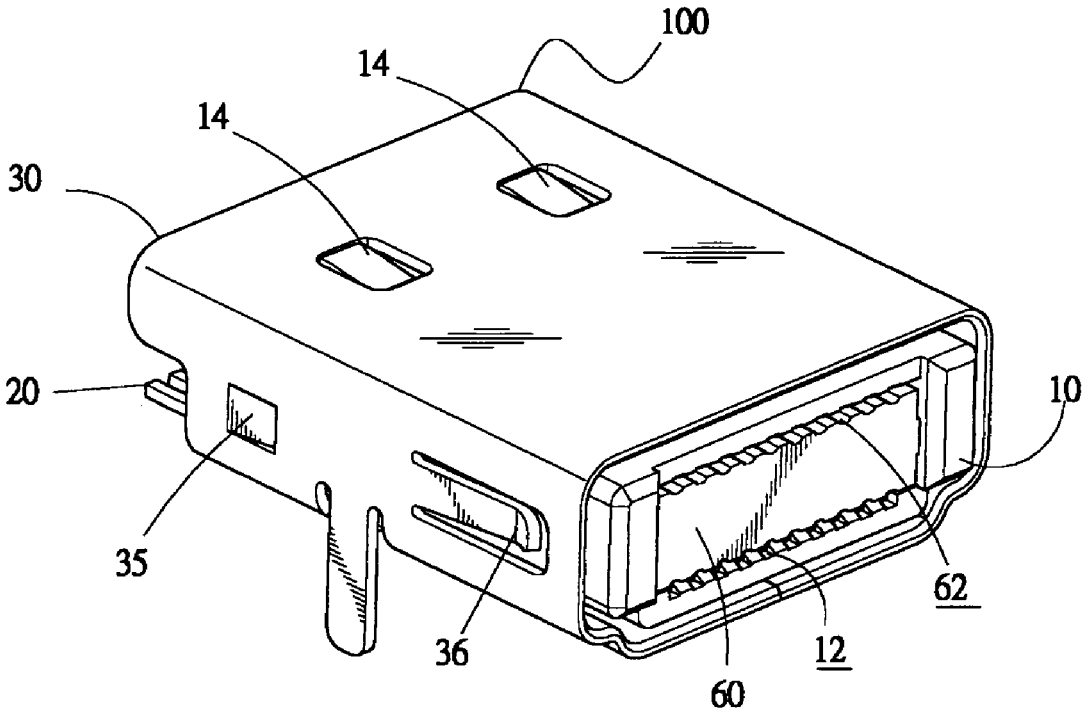
FIG. 1 is a perspective view of a dustproof receptacle connector in accordance with the present invention.
Figure 2:
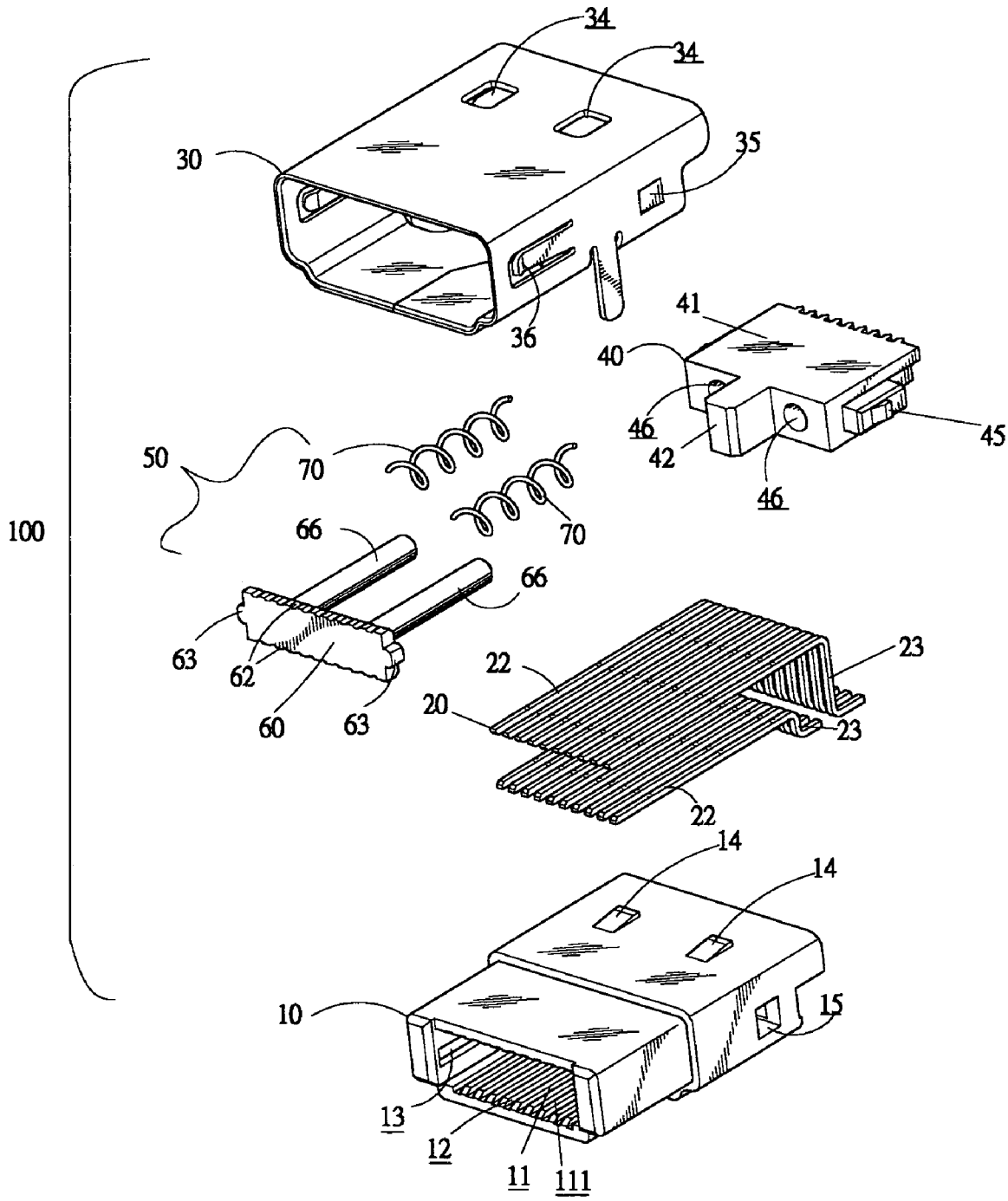
FIG. 2 is an exploded view of the dustproof receptacle connector in accordance with the present invention.

With reference to FIGS. 1 and 2, a dustproof receptacle connector 100 in accordance with the present invention comprises a dielectric housing 10, a female shield 30 encircling the housing 10, a plurality of female contacts 20 and a slider unit 50 which are both disposed in the housing 10.

As shown in FIG. 2, the housing 10 has a top wall, a bottom wall opposite the top wall, two opposite side walls disposed between the top and bottom walls, and a rear wall disposed at the rear end of the prior four walls, together with a receiving cavity 11 defined therebetween. The receiving cavity 11 further has a front opening 111 defined in the front surface of the housing 10. A plurality of contact grooves 12 is respectively defined in inner surface of the top and bottom walls of the housing 10 in juxtaposed relation for holding the corresponding female contacts 20 and communicates with the receiving cavity 11. Two elongated guiding slots 13 with each having a closed front end are respectively defined at the inner surface of two opposite side walls of the housing 10 and communicate with the receiving cavity 11. The housing 10 further has a pair of projecting wedges 14 disposed on the top wall thereof and a pair of locking holes 15 defined respectively through the two opposite side walls thereof. In addition, the housing 10 is provided with a block 40 infixed into and substantially sealing the rear end thereof as the rear wall of the housing 10. The block 40 has a base 41, a partition 42 extending forwards from the front surface of the base 41, two mounting holes 46 respectively defined in the front surface of the base 41 at two sides of the partition 42 and two side wedges 45 protruding from the two opposite side surfaces of the base 41 for locking into the corresponding locking holes 15 of the housing 10 respectively. Each mounting hole 46 is a blind hole communicating with the receiving cavity 11. According to the present invention, the block 40, as a component of the housing 10, can be molded separately or molded as one piece with the housing 10.

Correspondingly, the female shield 30 has a pair of locking apertures 34 defined in the top surface thereof for receiving the projecting wedges 14 of the housing 10 respectively, and a pair of locking tabs 35 disposed respectively at two opposite side surfaces thereof for engaging with the locking holes 15 of the housing 10. The female shield 30 is further provided with two latching arms 36 disposed respectively at the two opposite side surfaces thereof adjacent to the corresponding locking tab 35.

Figure 7:
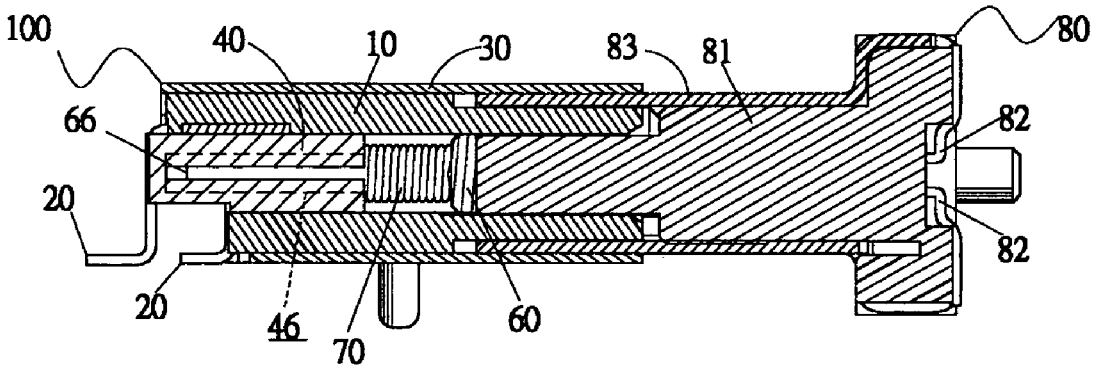

Referring to FIGS. 1 and 2 again, the female contacts 20 are divided into two rows and disposed respectively in the top and bottom walls of the housing 10. Each female contact 20 has an elongated conductive portion 22 held in the corresponding contact groove 12, and a L-shape solder portion 23 disposed at the rear end of the contact 20. The conductive portions 22 of the female contacts 20 are used for mating with a mating plug connector 80 as shown in FIG. 7. The solder portions 23 of the female contacts 20 all extend outwards from the rear end of the housing 10 respectively for being soldered to a circuit board in two rows (not shown), in which the solder portions 23 of the female contacts 20 in the bottom wall of the housing 10 are disposed in front of those in the top wall of the housing 10.

The slider unit 50 is slidably received in the receiving cavity 11, which includes a flat dustproof cover 60 for sealing the front opening 111 of the housing 10 and a pair of springs 70. The dustproof cover 60 has top and bottom surfaces formed as two opposite scalloped surfaces 62 for engaging with the corresponding conductive portions 22 of the female contacts 20 respectively, and two protuberances 63 projecting outwards respectively from two opposite side surfaces thereof corresponding to the guiding slots 13 of the housing 10. The dustproof cover 60 is further provided with a pair of longitudinal pillars 66 projecting rearwards from the rear surface thereof. Each spring 70 is retained on the corresponding pillar 66, with one end thereof abutting against the rear surface of the dustproof cover 60 and the other end thereof abutting against the front surface of the base 41 in the housing 10 (as shown in FIG. 5).

As assembling, the block 40 is infixed into the rear end of the housing 10, with the two side wedges 45 thereof locking into the corresponding locking holes 15 of the housing 10 respectively. Each female contact 20 is mounted in the housing 10, with the conductive portion 22 thereof held in the corresponding contact groove 12 of the housing 10 and the solder portion 23 thereof exposed to the rear end of the housing 10. The two springs 70 are retained respectively on the corresponding pillar 66 of the dustproof cover 60 to form the slider unit 50. The slider unit 50 is inserted into the receiving cavity 11 of the housing 10, with the two protuberances 63 of the dustproof cover 60 respectively received in the corresponding guiding slots 13 and abutting against the closed front end of the guiding slots 13, and the free end of each pillar 66 located respectively in the corresponding mounting hole 46. At this time, the springs 70 is located between the dustproof cover 60 and the block 40, and the scalloped surfaces 62 of the dustproof cover 60 engage with the conductive portions 22 of the female contacts 20 for sealing the front opening 111 of the receiving cavity 11. The female shield 30 encircles the housing 10, with the locking apertures 34 thereof holding the corresponding projecting wedges 14 of the housing 10 and the locking tabs 35 thereof received in the corresponding locking holes 15 of the housing 10. In addition, with the design of the partition 42 of the block 40, the two springs in this embodiment can avoid entwining with each other.

Figure 3:
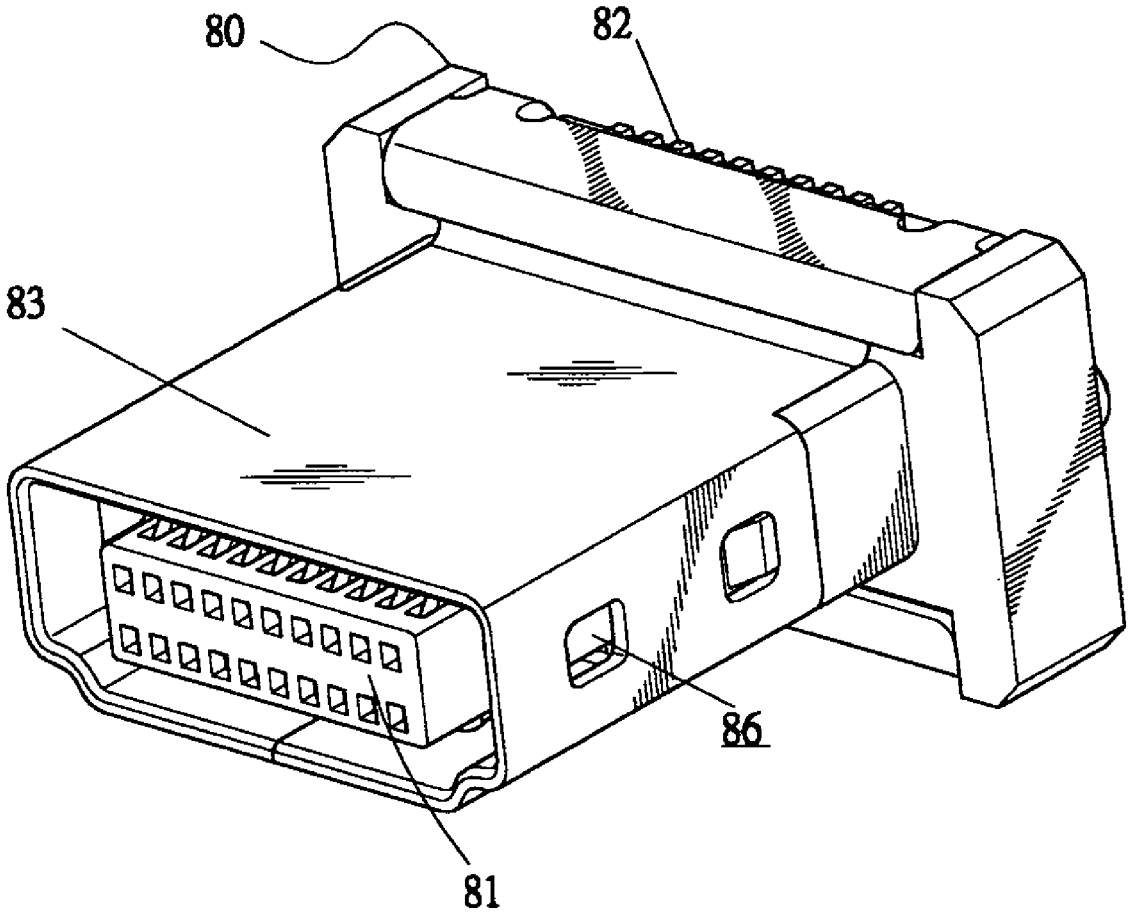
FIG. 3 is a perspective view showing a mating plug connector employed for mating with the dustproof receptacle connector in accordance with the present invention.
Figure 4:
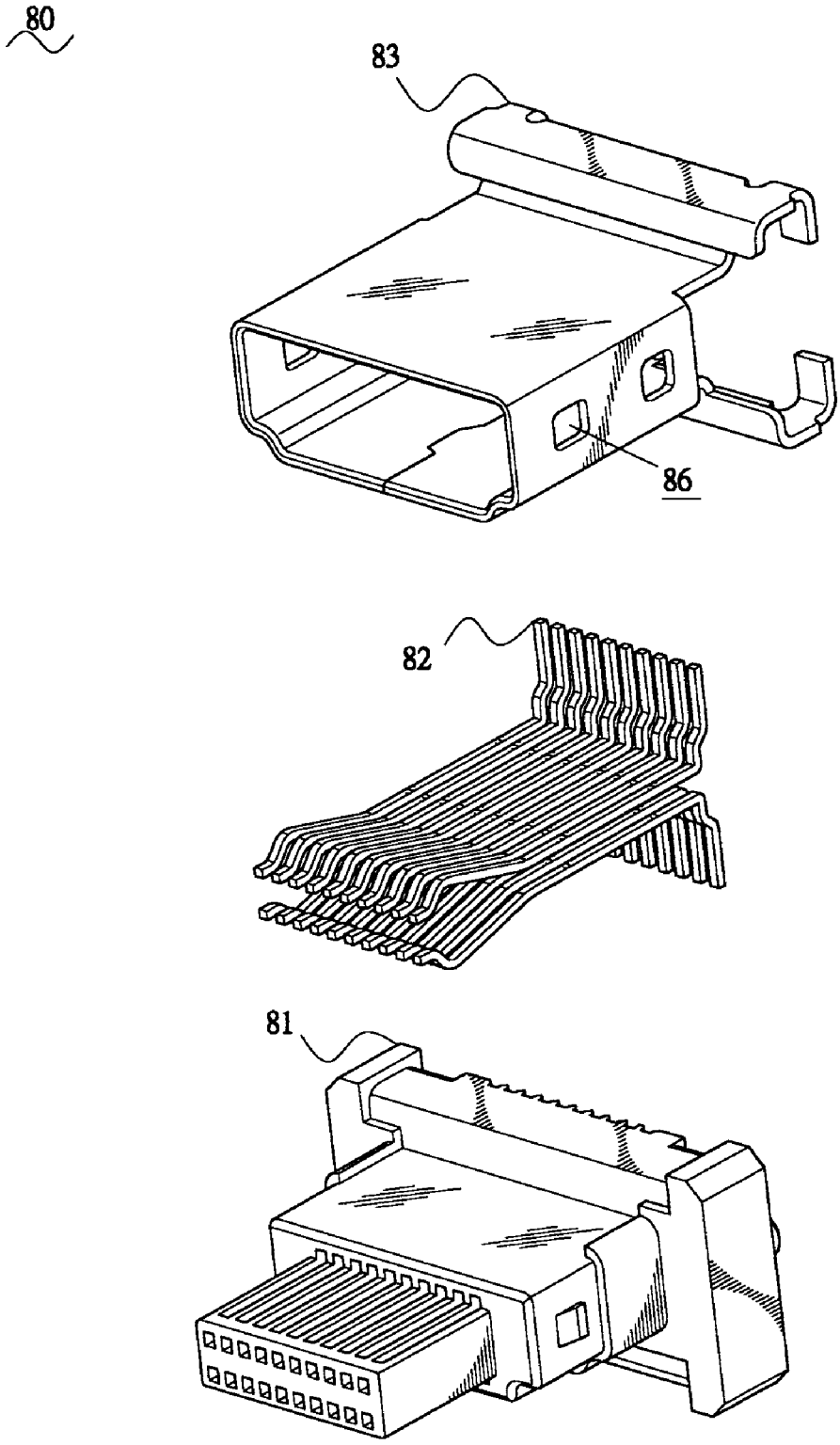
FIG. 4 is an exploded view of the mating plug connector as shown in FIG. 3.
Figure 6:
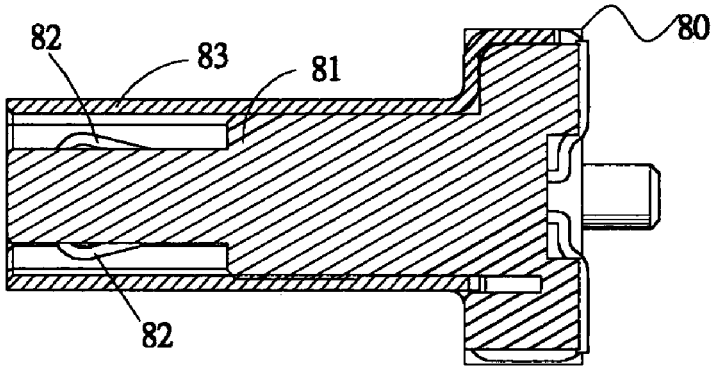
FIG. 6 is a cross-sectional view of the mating plug connector as shown in FIG. 3.

As shown in FIGS. 3, 4 and 6, the mating plug connector 80 for mating with the dustproof receptacle connector 100 comprises a body 81, a male shield 83 encircling the body 81, and a plurality of male contacts 82 arranged in the body 81. The male shield 83 has a pair of latching holes 86 corresponding to the latching arms 36 of the dustproof receptacle connector 100. The male contacts 82 are provided for making electrical connection with the female contacts 20 of the dustproof receptacle connector 100 to transmit electrical signals.

Figure 5:
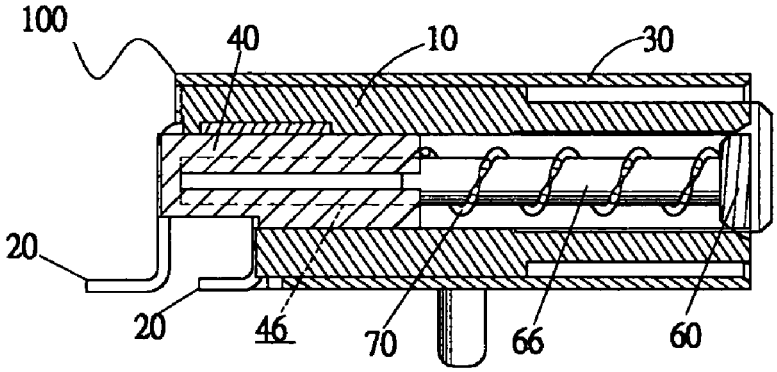
FIG. 5 is a cross-sectional view of the dustproof receptacle connector as shown in FIG. 1.

Referring to FIGS. 5 and 7, when the mating plug connector 80 is inserted into the receiving cavity 11 of the dustproof receptacle connector 100, the dustproof cover 60 is forced to slide backwards in the receiving cavity 11 by the body 81 of the mating plug connector 80, with the protuberances 63 of the dustproof cover 60 sliding backwards in the guiding slots 13 and the pillars 66 sliding backwards in the mounting holes 46, until the latching arms 36 of the dustproof receptacle connector 100 lock into the corresponding latching holes 86 of the mating plug connector 80. At this time, the springs 70 retained on the pillars 66 are compressed between the dustproof cover 60 and the block 40 as shown in FIG. 7. When the mating plug connector 80 is pulled out from the receiving cavity 11 of the dustproof receptacle connector 100, the compressed springs 70 gradually reinstate the primary form and push the dustproof cover 60 to slide forwards, until the protuberances 63 of the dustproof cover 60 is stopped by the closed front end of the guiding slots 13 of the housing 10.

In the dustproof receptacle connector 100 of the present invention, with the design of the scalloped surfaces 62, the dustproof cover 60 engages with the conductive portions 22 of the female contacts 20 and is appropriate for closely sealing the front opening 111 of the dustproof receptacle connector 100, and any contaminant can be wiped by sliding of the scalloped surfaces 62 on the conductive portion 22 of the female contacts 20. In addition, with the design of the free ends of the longitudinal pillars 66 located in the corresponding mounting holes 46 and the springs 70 retained entirely on the corresponding pillars 66, the lateral deformation of the springs 70 can be avoided. Furthermore, the mounting holes 46 ensure that the longitudinal pillars 66 only slide in the direction from front to rear, thereby the dustproof cover 60 can steadily and appropriately slide in the receiving cavity 11. That is, the dustproof receptacle connector 100 is qualified to provide a perfect and reliable dustproof function.

What is claimed is:

1. A dustproof receptacle connector comprising:

a dielectric housing having a receiving cavity with a front opening defined in a front surface of the dielectric housing, and at least one mounting hole defined in a rear wall of the dielectric housing communicating with said receiving cavity;

a plurality of terminals disposed in the dielectric housing; and a slider unit slidably received in said receiving cavity, comprising a dustproof cover for sealing said front opening of said receiving cavity and at least one spring, at least one longitudinal pillar extending backwards from said dustproof cover, with the free end of the pillar slidably disposed in said mounting hole of the dielectric housing, and said spring retained on the longitudinal pillar with one end of said spring abutting against the dustproof cover and the other end of said spring abutting against the rear wall of the dielectric housing wherein said dustproof cover has top and bottom surfaces formed as two opposite scalloped surfaces for engaging with the corresponding conductive portions of said plurality of terminals respectively.

2. The dustproof receptacle connector as claimed in claim 1, wherein said rear wall is formed as a block infixed into the rear end of the dielectric housing, with two mounting holes defined in said block.

3. The dustproof receptacle connector as claimed in claim 2, wherein the block further has a partition extending forwards from the front surface thereof, with said two mounting holes respectively defined at both sides of said partition.

4. The dustproof receptacle connector as claimed in claim 1, wherein the dielectric housing has two guiding slots defined respectively at inner surface of two opposite side walls thereof and communicating with said receiving cavity, with each guiding slot having a closed front end.

5. The dustproof receptacle connector as claimed in claim 4, wherein said dustproof cover has two protuberances projecting outwards respectively from two opposite side surfaces thereof for engaging with the corresponding guiding slots of the dielectric housing.

6. The dustproof receptacle connector as claimed in claim 1, wherein the dielectric housing having a plurality of contact grooves communicating with said receiving cavity for holding the corresponding plurality of terminals respectively.

* * * * *